US005953764A

United States Patent [19]

Lin

[11] Patent Number: 5,953,764

[45] Date of Patent: Sep. 21, 1999

[54] SANITARY TOILET BOWL SEAT ENVELOPE

[76] Inventor: Hsi Huang Lin, P.O. Box 82-144, Taipei, Taiwan

[21] Appl. No.: 08/572,881

[22] Filed: Dec. 18, 1995

[51] Int. Cl.[6] ..... A47K 13/14

[52] U.S. Cl. ..... 4/245.4; 4/245.9

[58] Field of Search ..... 4/245.9, 245.1, 4/300.3

[56] References Cited

U.S. PATENT DOCUMENTS

| | | | |
|---|---|---|---|
| 597,264 | 1/1898 | Conradi | 4/245.9 X |
| 1,293,955 | 2/1919 | Sloan | 4/245.9 |
| 1,505,067 | 8/1924 | Lahmer | 4/245.9 |
| 4,766,617 | 8/1988 | Thygesen et al. | 4/245.9 X |
| 5,323,495 | 6/1994 | Han | 4/245.9 X |

FOREIGN PATENT DOCUMENTS

| | | | |
|---|---|---|---|
| 1920231 | 12/1970 | Germany | 4/245.1 |

*Primary Examiner*—Charles E. Phillips
*Attorney, Agent, or Firm*—Beveridge, Degrandi Weilacher & Young LLP

[57] ABSTRACT

A sanitary toilet bowl seat envelope including a seat member having a central opening and a tongue extending inwardly from a circumference of central opening, and an elongated strap arranged under the central opening of the seat portion and having two ends connected with respective sides of the seat member, the elongatedstrap being provided with wrinkles.

1 Claim, 5 Drawing Sheets

SANITARY TOILET BOWL SEAT ENVELOPE

FIELD OF THE INVENTION

This invention relates to an improved sanitary toilet bowl seat envelope.

DESCRIPTION OF THE PRIOR ART

It has been found that the conventional toilet bowl seat cover is simply a piece of paper adapted to cover the upper side of the toilet bowl seat only. However, such a toilet bowl seat cover cannot entirely prevent the sexual organ of an user from directly contacting the toilet bowl thereby making it unfit for sanitary use.

Therefore, it is an object of the present invention to provide an improved sanitary toilet bowl seat envelope which can obviate and mitigate the above-mentioned drawbacks.

SUMMARY OF THE INVENTION

This invention relates to a sanitary toilet bowl seat envelope.

It is the primary object of the present invention to provide a sanitary toilet bowl seat envelope which can prevent contagion of diseases by contact.

It is another object of the present invention to provide a sanitary toilet bowl seat envelope which can prevent the excretion from directly dropping into a toilet bowl.

It is still another object of the present invention to provide a sanitary toilet bowl seat envelope which can prevent water from splashing up to wet the user.

It is still another object of the present invention to provide a sanitary toilet bowl seat envelope which can will not slip out of the toilet bowl.

It is a further object of the present invention to provide a sanitary toilet bowl seat envelope which is inexpensive in cost.

Other objects of the invention will in part be obvious and in part hereinafter pointed out.

The invention accordingly consists of features of constructions and method, combination of elements, arrangement of parts and steps of the method which will be exemplified in the constructions and method hereinafter disclosed, the scope of the application of which will be indicated in the claims following.

BRIEF DESCRIPTION OF THE PREFERRED EMBODIMENT

DETAILED DESCRIPTION OF THE PREFERRED EMBODIMENT

Figure 1A:
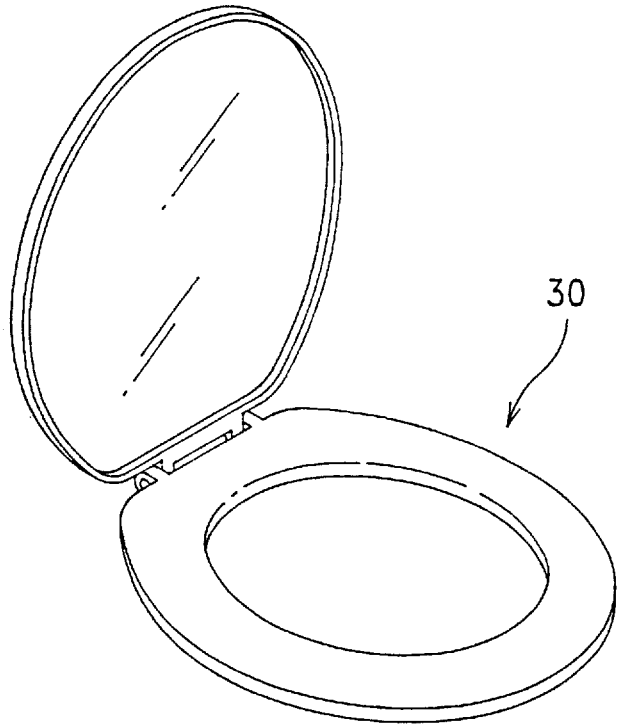
FIG. 1A illustrates a commonly used toilet bowl seat.

For the purpose to promoting an understanding of the principles of the invention, reference will now be made to the embodiment illustrated in the drawings. Specific language will be used to describe same. It will, nevertheless, be understood that no limitation of the scope of the invention is thereby intended, such alternations and further modifications in the illustrated device, and such further applications of the principles of the invention as illustrated herein being contemplated as would normally occur to one skilled in the art to which the invention relates.

Figure 1:
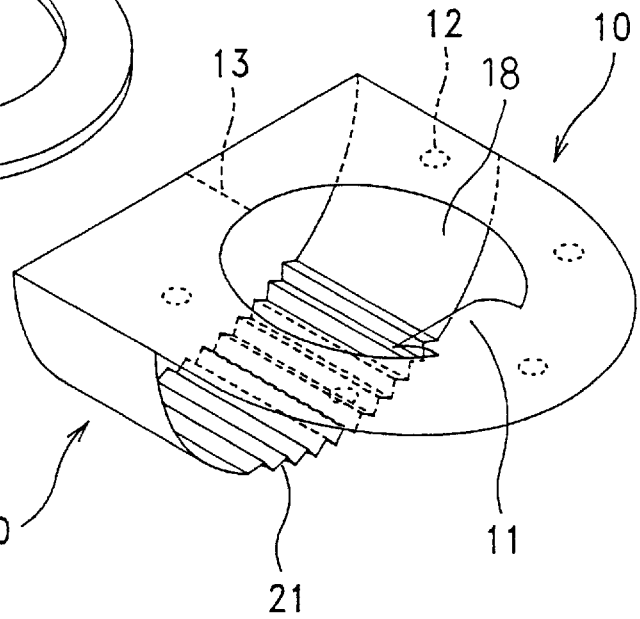
FIG. 1 is a perspective view of a sanitary toilet bowl seat envelope according to the present invention.
Figure 2:
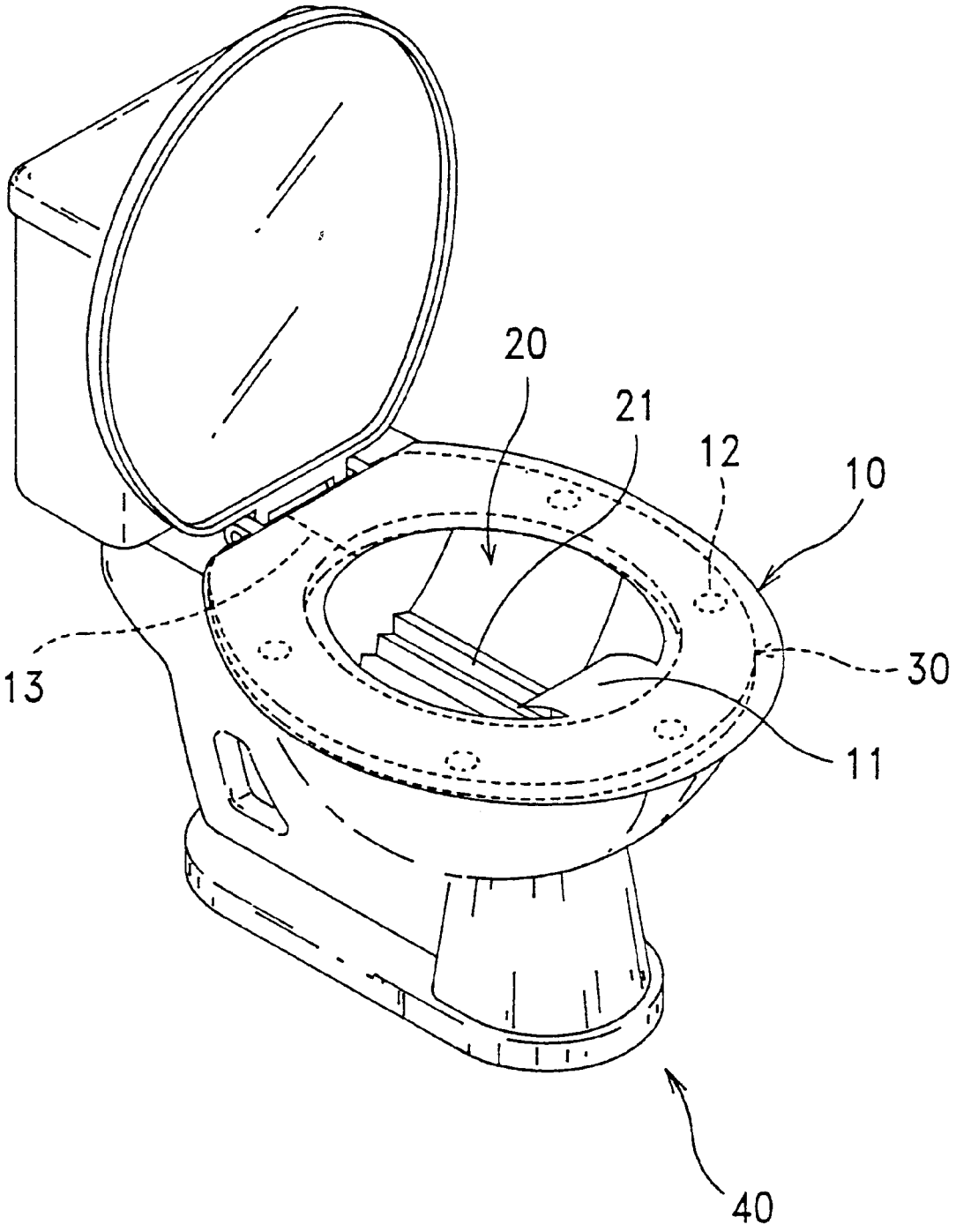
FIG. 2 is a working view of the sanitary toilet bowl seat envelope.

With reference to the drawings and in particular to FIGS. 1, 1A and 2 thereof, the sanitary toilet bowl seat envelope according to the present invention mainly comprises a seat member 10 and a strap 20.

The seat member 10 has a similar shape as the toilet bowl seat 30 and is formed with an opening 18 at its central portion and a tongue 11 extending inwardly from the circumference of the opening 18. The bottom of the seat member 10 is provided with adhesive 12 for sticking on the toil bowl seat 30.

The strap 20 has two ends connected with respective sides of the seat member 10 by known means. Further, the strap 20 is provided with fold lines or wrinkles 21 at the intermediate portion, which are used for making the strap 20 resilient. The rear portion of the seat member 10 has a perforation or tearing line 13 extending through the circumference of the opening 18 to the rear edge of the seat member 10.

Figure 3:
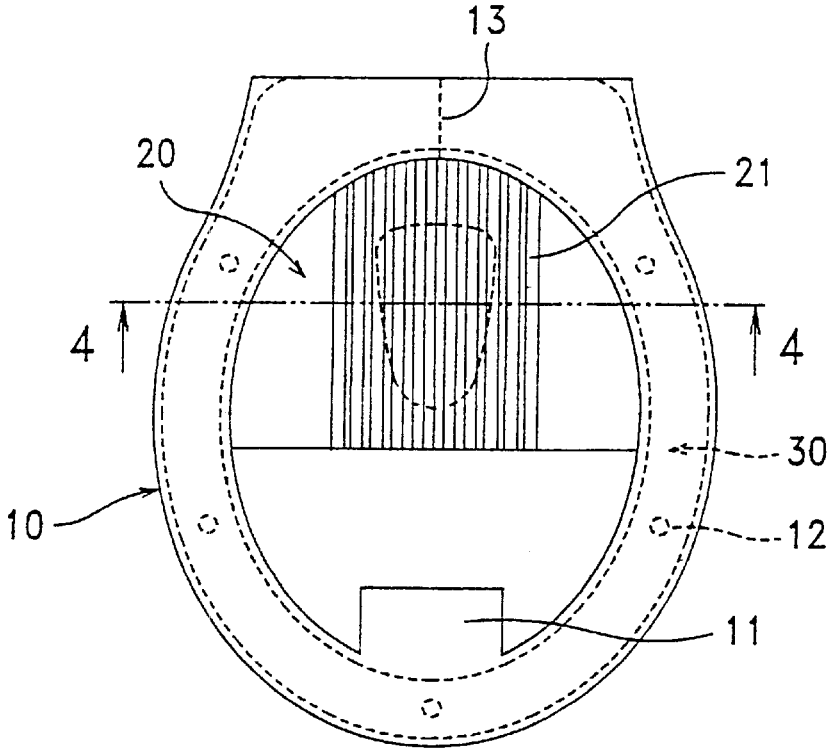
FIG. 3 is a top view of the sanitary toilet bowl seat envelope arranged on a toilet bowl seat.
Figure 4:
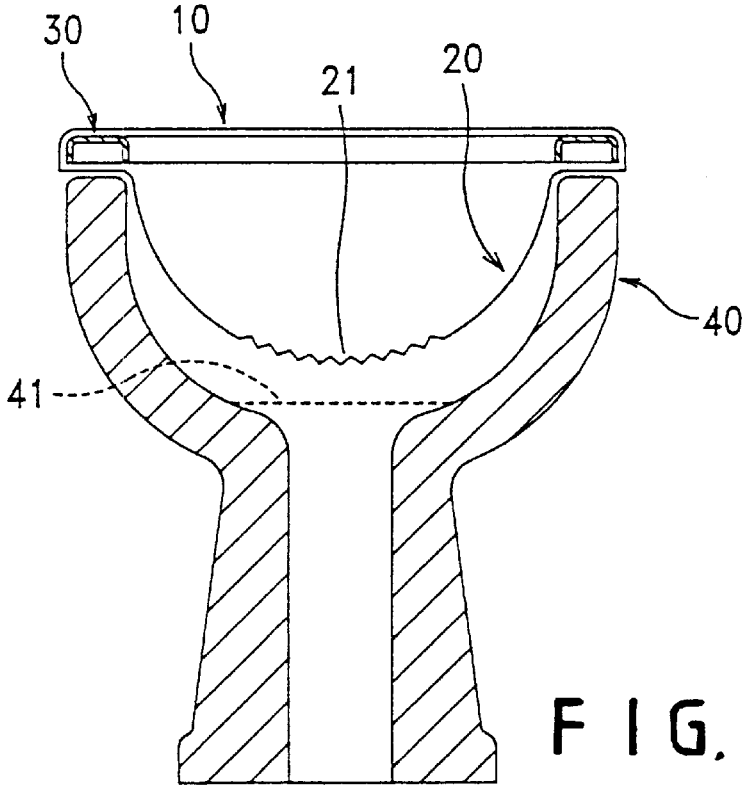
FIG. 4 is a sectional view showing the sanitary toilet bowl seat envelope arranged on a toilet bowl seat.

When in use, it is only necessary to put the sanitary toilet bowl seat envelope on the seat 30 of a toilet bowl, with the strap 20 depending into the toilet bowl (see FIGS. 2, 3 and 4). Then, the envelope will be stuck on the seat 30 by the adhesive 12. The length of the strap 20 is designed so that the strap 20 will not touch the water in the toilet bowl. Hence, when the excretion released from an user will first drop onto the wrinkles 21 of the strap 2 before falling into the water of the toilet bowl thereby preventing water from splashing up to wet the user. Furthermore, the tongue 11 of the seat member 10 will prevent the sexual organ of an user from directly touching the toilet bowl thus avoiding contagion of diseases by contact.

Figure 5:
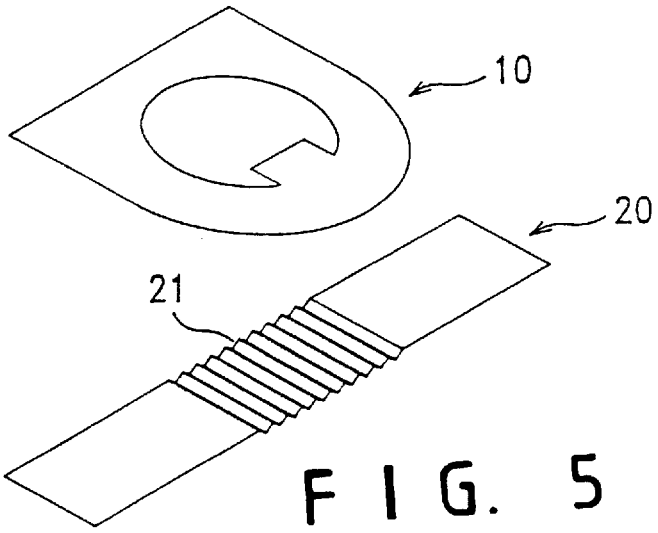
FIG. 5 illustrates a second preferred embodiment of the sanitary toilet bowl seat envelope.

FIG. 5 illustrates a second preferred embodiment of the sanitary toilet bowl seat envelope, in which the seat member 10 and the strap 20 are two separate portions to be stuck together.

Figure 6:
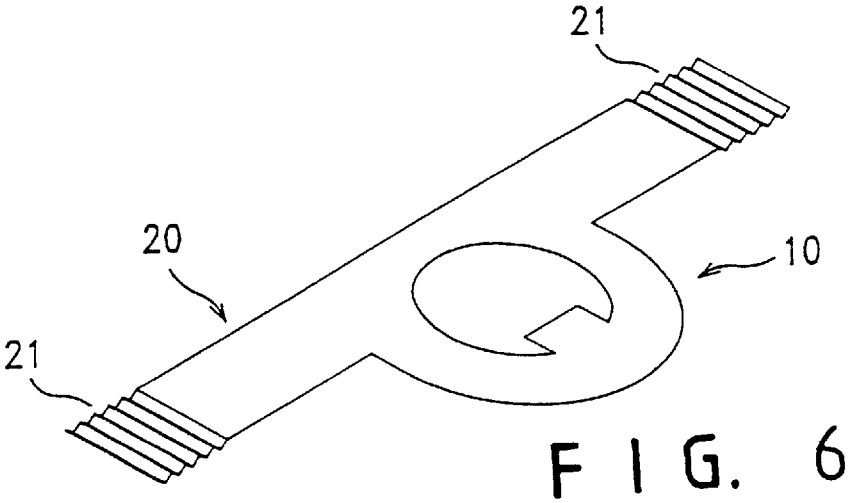
FIG. 6 illustrates a third preferred embodiment of the sanita toilet bowl seat envelope.

FIG. 6 illustrates a third preferred embodiment of the sanitary toilet bowl seat envelope. According to this embodiment, the seat member 10 has two side portions extending outwardly to form a strap 20 having wrinkles 21 at both ends which are to be stuck together.

Figure 7:
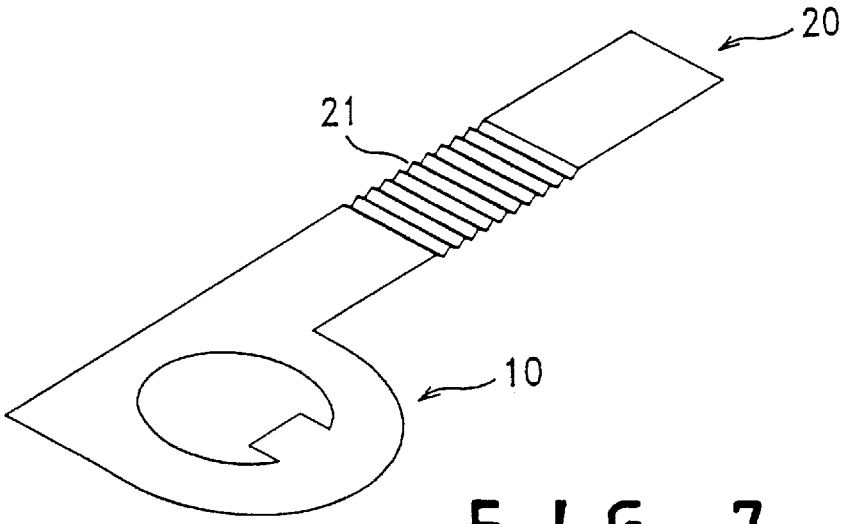
FIG. 7 illustrates a fourth preferred embodiment of the sanitary toilet bowl seat envelope.

FIG. 7 illustrates a fourth preferred embodiment of the sanitary toilet bowl seat envelope. As shown, the seat member 10 is integrally formed with the strap 20 which extends outward from one side of the seat member 10 and is to be stuck on the other side of the seat member 10.

Figure 8:
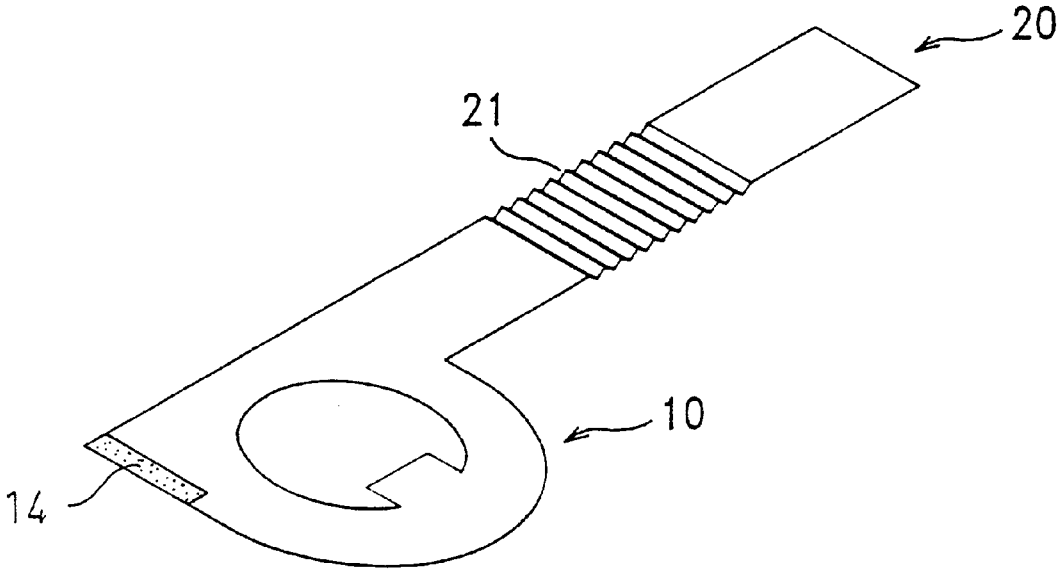
FIG. 8 illustrates a fifth preferred embodiment of the sanitary toilet bowl seat envelope.

FIG. 8 illustrates a modification of the fourth preferred embodiment of the sanitary toilet bowl seat envelope. As illustrated, the seat member 10 is provided with adhesive 14 at one side for sticking the end of the strap 20.

The invention is naturally not limited in any sense to the particular features specified in the forgoing or to the details of the particular embodiment which has been chosen in order to illustrate the invention. Consideration can be given to all kinds of variants of the particular embodiment which has been described by way of example and of its constituent elements without thereby departing from the scope of the invention. This invention accordingly includes all the means constituting technical equivalents of the means described as well as their combinations.

I claim:

1. A sanitary toilet bowl seat envelope comprising a member for covering said seat, said member having an inner periphery forming a central opening and an outer periphery, a tongue extending inwardly from a circumference of said central opening, two side portions extending one each from opposite sides of said envelope by attachment to said outer periphery to form an elongated strap arranged under said central opening of said seat member, said strap being provided with fold lines such as to render said strap resilient, said seat member having a bottom provided with adhesive, said seat member having a perforation line at a rear portion of said seat member and located opposite to said tongue; wherein in use said seat member is adhered to a toilet seat by said adhesive with said strap being suspended above the bowl water in order to serve as a splash guard for excrement of the user.

* * * * *